United States Patent [19]

Zeeman

[11] 4,037,846

[45] July 26, 1977

[54] ALPHABET CUBE PUZZLE

[76] Inventor: Joan Javits Zeeman, R.F.D. Box 126, Waitsfield, Vt. 05673

[21] Appl. No.: 652,932

[22] Filed: Jan. 27, 1976

[51] Int. Cl.[2] ..... A63F 9/12; G09B 1/08; G09B 1/10

[52] U.S. Cl. ..... 273/157 R; 35/31 D; 35/35 H; 35/70; 35/71; 35/73

[58] Field of Search ..... 273/156, 157, 160; 35/22 A, 31 D, 31 F, 31 G, 35 H, 35 J, 69, 70, 71, 72, 73; D34/15 M

[56] References Cited

U.S. PATENT DOCUMENTS

| | | | |
|---|---|---|---|
| 610,577 | 9/1898 | Baldwin | 35/72 |
| 1,439,336 | 12/1922 | Smith | 273/157 R |
| 1,856,650 | 5/1932 | McLintock et al. | 35/73 |
| 2,987,318 | 6/1961 | Hammer | 273/157 R |
| 3,235,263 | 2/1966 | Smith | 273/156 |
| 3,608,906 | 9/1971 | Odier | 273/157 R |
| 3,726,027 | 4/1973 | Cohen et al. | 35/73 |
| 3,865,382 | 2/1975 | Myller | 273/157 R |
| D. 212,242 | 9/1968 | Paulos | 273/157 R |

FOREIGN PATENT DOCUMENTS

| | | | |
|---|---|---|---|
| 1,108,410 | 8/1955 | France | 35/69 |
| 1,242,975 | 8/1971 | United Kingdom | 273/157 R |

OTHER PUBLICATIONS

Oz Jig Saw Cubes Advertisement, Oz Puzzle Co., Watertown, Conn., 1 page, copyright 1975.

Alphabet Cube Advertisement, Parade Magazine, Nov. 12, 1972, p. G6.

*Primary Examiner*—Anton O. Oechsle

*Attorney, Agent, or Firm*—Blum, Moscovitz, Friedman & Kaplan

[57] ABSTRACT

A cubic puzzle especially suitable for teaching the alphabet to children as well as serving as an adult puzzle. Puzzle members formed in the shape of alphabetic and numeric representations are releasably mounted on each surface of a cube. The alphabetic and numeric representations are inter-fitted to have a specific position on the cube surface and effect a puzzle on each surface.

71 Claims, 27 Drawing Figures

ALPHABET CUBE PUZZLE

BACKGROUND OF THE INVENTION

This invention relates generally to a cubic puzzle and especially to an alphabet cube puzzle for providing educational development coupled with play value. While alphabet puzzles have taken various forms, it is recognized that the inclusion of substantial play value in the puzzle enhances the educational value to be gained therefrom. Alphabet puzzles have generally failed to provide each substantial play value and have therefore yielded less than completely satisfactory results. Further, it is desired to provide a puzzle capable of serving as an adult puzzle as well as providing aesthetic appeal.

SUMMARY OF THE INVENTION

Generally speaking, in accordance with the invention an alphabet cube puzzle is provided for effecting the teaching of the alphabet to children as well as serving as an adult puzzle. The puzzle is constructed with specific engaging means formed on each side of a cube, which specific engaging means are adapted to secure a specific plurality of puzzle pieces shaped in the form of an alphabetic or numeric character. The puzzle pieces are formed so that the inter-fitting of the puzzle pieces substantially covers the whole surface of the cube.

Accordingly, it is an object of this invention to provide an improved alphabet cube puzzle capable of educating children and serving as an adult puzzle.

Another object of the invention is to provide an improved alphabet cube puzzle capable of providing entertainment value to a child to enhance the educational value thereof as well as being capable of providing entertainment to adults.

Still other objects and advantages of the invention will in part be obvious and will in part be apparent from the specification and drawings.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
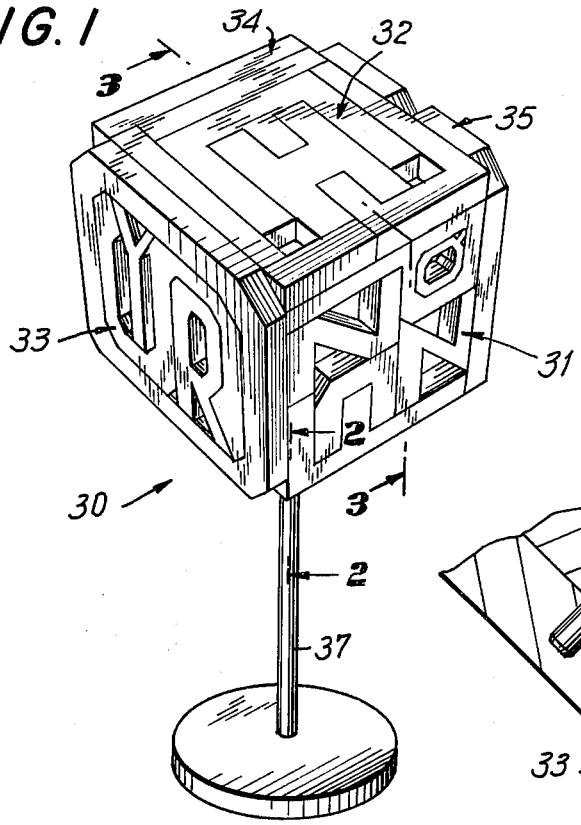
FIG. 1 is a perspective view of an alphabet cube puzzle constructed in accordance with the preferred embodiment of the instant invention.
Figure 2:
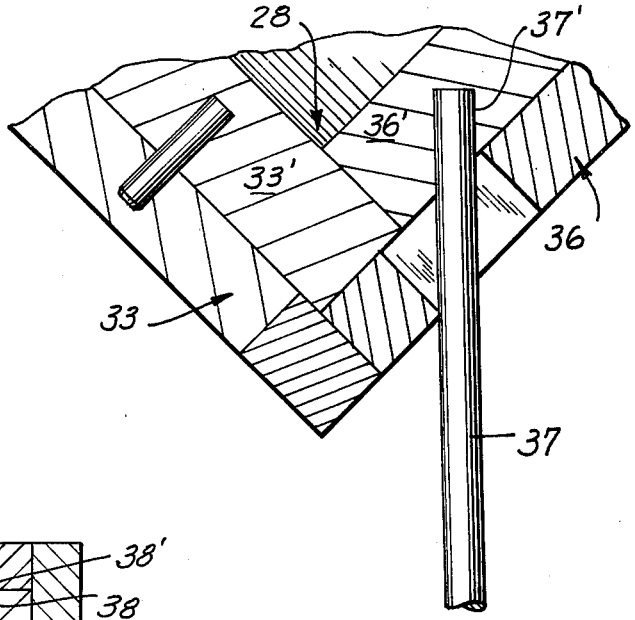
FIG. 2 is a fragmentary enlarged sectional view taken along lines 2—2 of FIG. 1.

Referring now to FIGS. 1 through 10, a cubic puzzle, indicated generally at 30, is formed of six sides each defined by a plurality of selected letters or numbers of predetermined shape, namely front side 31, top side 32, left side 33, rear side 34, right side 35 and bottom side 36, all as viewed in FIG. 1, supported on a stand 37. The stand 37 is shown by way of illustration only and the puzzle may be provided without the stand. The stand, if provided, extends through a space between puzzle pieces and is received in an aperture 37' in wall 36'.

Figure 3:
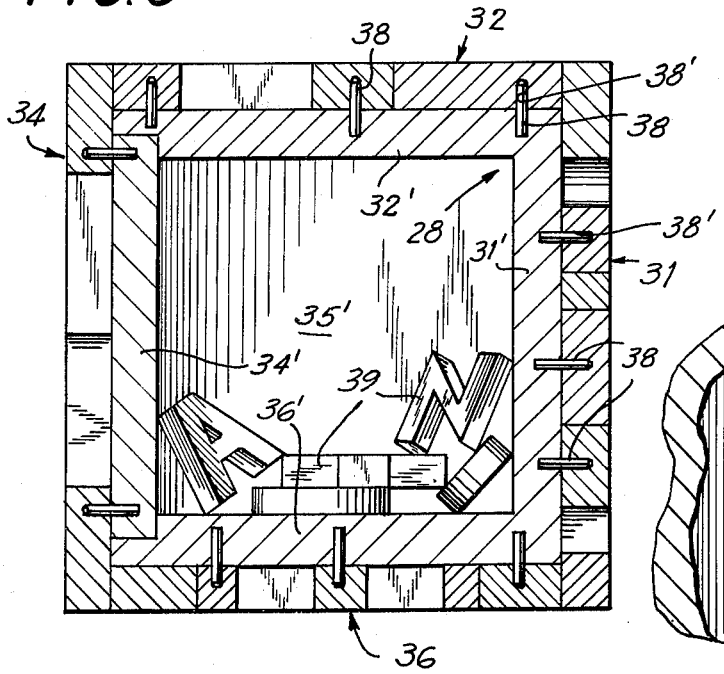
FIG. 3 is a sectional view taken along lines 3—3 of FIG. 1.

The puzzle is formed of a reference member by securing walls 31' through 36' together into the shape of a cube. The walls 31' through 36' are constructed out of any lightweight sturdy material such as wood or plastic. Each wall 31' through 36' includes pegs 38 mounted therein. The pegs 38 are placed in a distinct relationship so that they correspond to corresponding holes 38' (shown in phantom in FIG. 4) formed in each puzzle piece. The respective puzzle pieces, are formed in alphabetic or numeric shapes. One wall 34' of reference member 34 may be removable to define a receptacle for receiving puzzle pieces or additional letters or numbers 39 (FIG. 3). In the alternative, the reference member may be a solid or hollow block without a removable wall.

Figure 4:
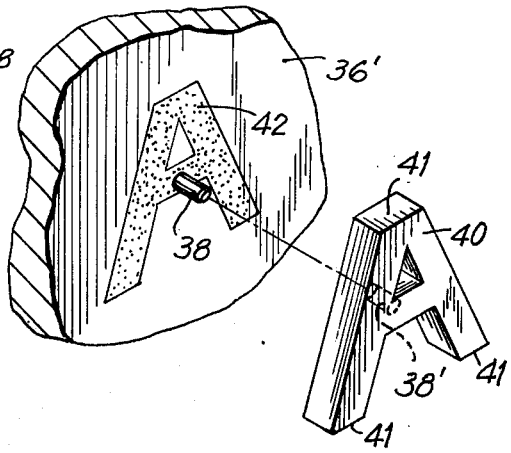
FIG. 4 is an exploded fragmentary perspective view of an alphabetic puzzle piece and mounting thereof constructed in accordance with the preferred embodiment of the instant invention.
Figure 8:
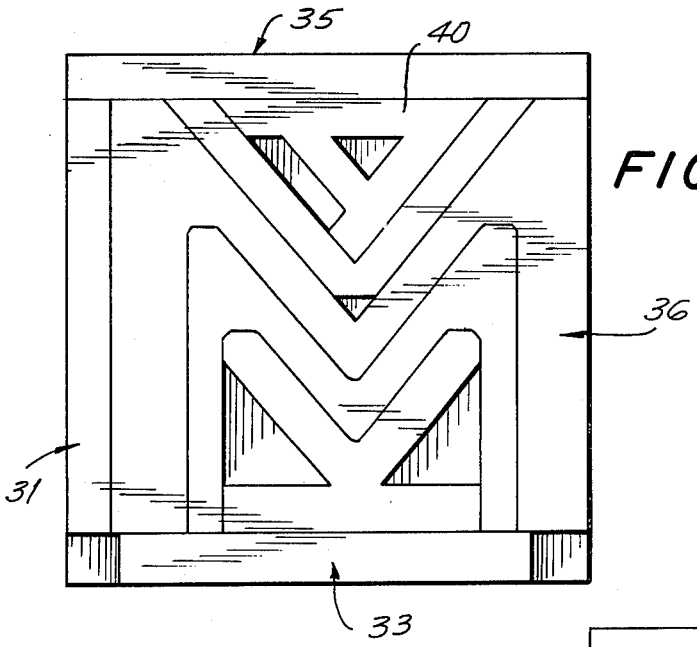

Specific reference is now made to FIGS. 4 and 8 wherein a puzzle piece 40, shaped in the form of an "A" is illustrated. The puzzle piece 40 includes a recessed hole 38' (shown in phantom) which hole allows the puzzle piece 40 to be releasably secured to a corresponding peg 38. The piece 40, as well as all the puzzle pieces, are formed with flat base portions 41 on the bottom edge thereof when viewed properly as a letter or number, to allow the puzzle piece to be stood on a flat surface to allow viewing of the puzzle pieces and enhance the educational value of the puzzle. A silhouette of the puzzle piece 42 may be included on the surface of the reference member to provide an aid in guiding a child as to where to place the puzzle piece. As is appreciated by the skilled artisan, if the puzzle piece is not placed on the proper peg it will become impossible to make all the puzzle pieces interfit in the desired manner. Thus, for the puzzle to be completed, recognition of letters and numerals, coupled with the ability to interfit all the pieces together to cover each surface of the reference member is necessary.

In the first embodiment of FIGS. 1–10, rear side 34 (FIG. 5) defines numerals 1 through 0; top sides 32 (FIG. 6) defines letters E, H, I, J and L; front side 31 (FIG. 7) defines letters F, N, P, Q, U and Z; bottom side 36 defines letters A, K, M, W and V, right side 35 defines letters B, C, D, G, T and X; and lefts side 33 defines letters O, R, S and Y. Each side is substantially covered by the stylistically shaped puzzle pieces. The sides are shaped so as to overlap so as to define a complete cube. The designations front, rear, etc. are arbitrary, it being apparent that sides 35 and 33 can be interchanged, as can sides 31, 32, 34 and 36. Further, as will become apparent below, other configurations of numbers can be utilized.

Referring to FIGS. 11 through 16, a second embodiment of the alphabet puzzle in accordance with the invention is depicted. The alphabet puzzle is formed of six sides, front side 44, right side 45, rear side 46, left side 47, top side 48 and bottom side 49, and is constructed in the same manner as the alphabet puzzle of FIGS. 1–10 except that each puzzle side is dimensioned to substantially correspond to or be less than the dimension of the corresponding side of the reference member so that when assembled, the edges of the cube are not filled in.

In the embodiment of FIGS. 11 – 16, front side 44 (FIG. 11) defines letters A, M, W and X; right side 45 (FIG. 12) defines letters E, F, I, J and L; rear side 46 (FIG. 13) depicts letters C, G, O, T and Q; left side 47 (FIG. 14) depicts letters B, D, K and V; top side 48 (FIG. 15) depicts letters H, N, V and Z; and bottom side 49 (FIG. 16) defines letters P, R, S and Y. In this embodiment the number of puzzle pieces are not provided. Of course, all of the sides may be interchanged with each other. The puzzle orientations of the other embodiments could be substituted for this embodiment if dimensioned so that each side defines a square.

Referring now to FIGS. 17 through 22, a third embodiment of the alphabet puzzle in accordance with the invention is depicted. The puzzle is formed of six sides, front side 51, right side 52, rear side 53, left side 54, top side 55 and bottom side 56 and is constructed in the same manner as the puzzles hereinabove described.

In the embodiment of FIGS. 17 through 22, front side 51 defines letters B, D, C, G, T and X; right side 52 (FIG. 18) defines letters E, H, I, J and L; rear side 53 (FIG. 19) depicts numerals 1 through 0; left side 54 (FIG. 20) depicts letters A, K, M, W and V; top side 55 (FIG. 21) depicts letters O, P, Q, R and S; and bottom view 56 (FIG. 22) depicts letters F, N, U, Y and X.

Referring now to FIGS. 23 – 26, four sides of a fourth embodiment in accordance with the invention is depicted. Specifically, the four sides are front side 61, bottom side 62, rear side 63 and left side 64. The right side would be identical to right side 52 of FIG. 18 while the top side would be identical to top side 55 of FIG. 21 of the third embodiment. In the embodiment of FIGS. 23 – 26, front side 61 (FIG. 23) depicts letters F, N, U, Y and X; bottom side 62 depicts letters B, C, D, G, T and X; rear side 63 depicts letters A, K, M, W and V; and left side 64 depicts numerals 1 through 9. It would be appreciated that the top and bottom sides are interchangeable, as are the front, rear, left and right sides.

Figure 18:
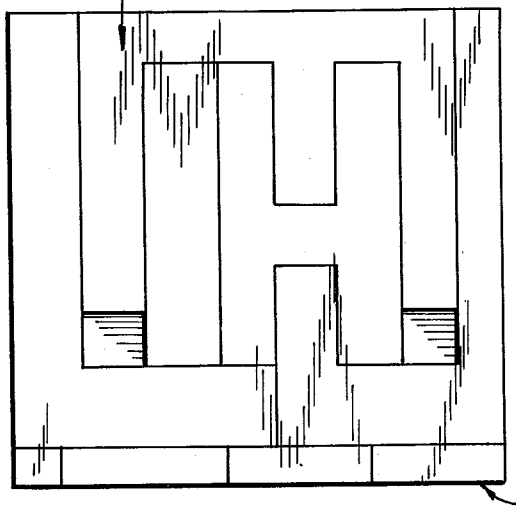
Figure 27:
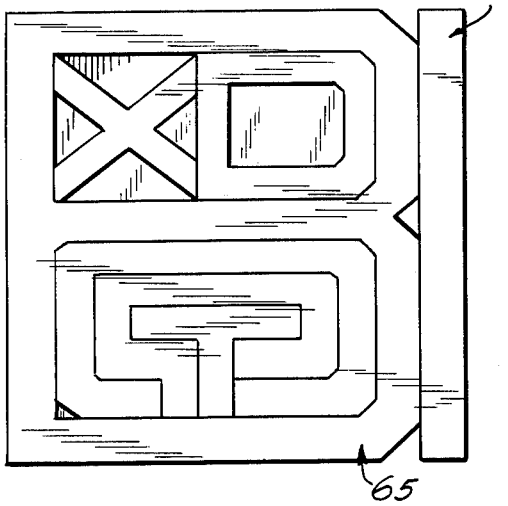
FIG. 27 is a front plan view of an alphabet puzzle in accordance with a fifth embodiment of the invention.
Figure 21:
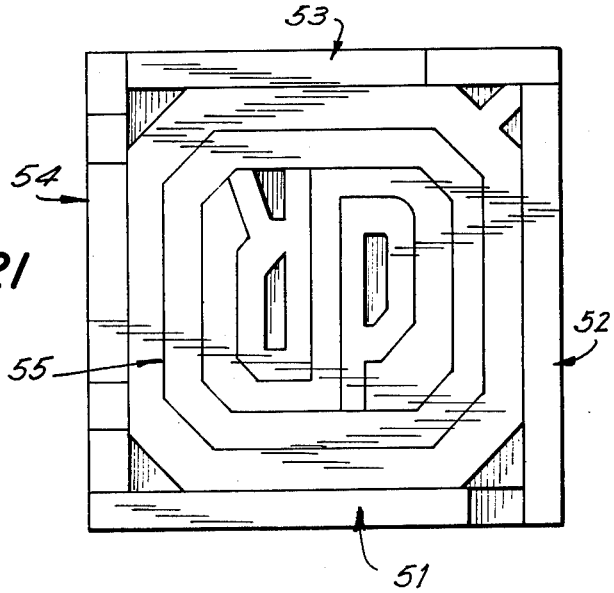
Figure 22:
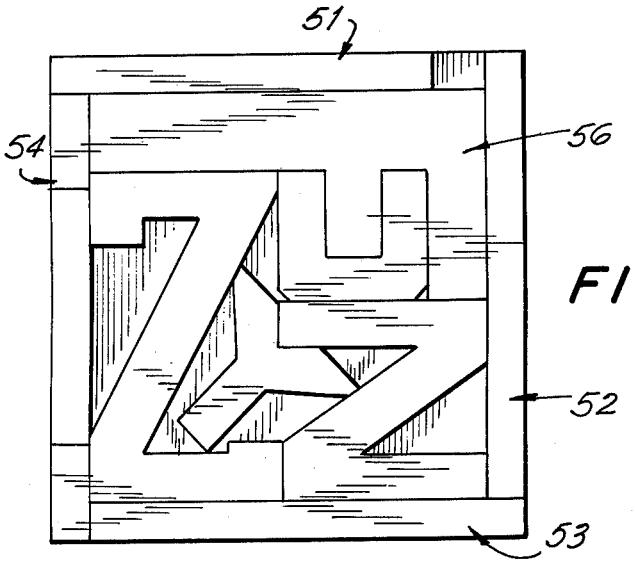
Figure 25:
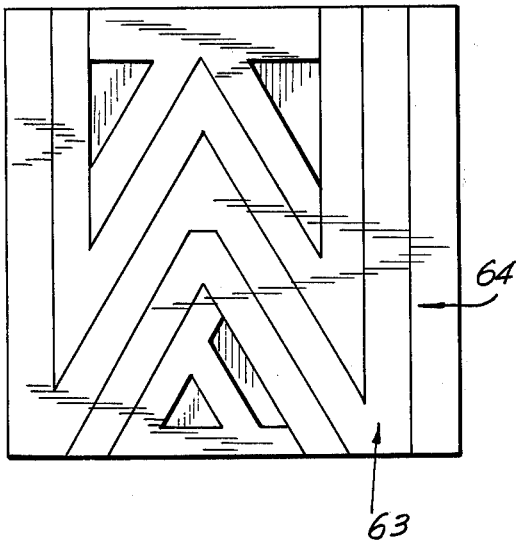
Figure 26:
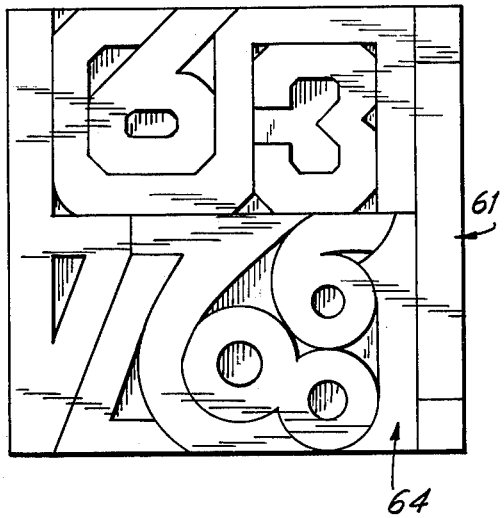

Turning now to FIG. 27, the front side 65 of a fifth embodiment is depicted, the balance of the alphabet puzzle in accordance with the invention being defined by the top side depicted in FIG. 22, the bottom side depicted in FIG. 21, the rear side depicted in FIG. 18, the left side depicted in FIG. 25 and the right side depicted in FIG. 26. Front side 65 (FIG. 27) depicts letters B, C, D, G, T and X.

It is understood that instead of pegs on the reference member, and holes formed in the puzzle pieces, the pegs may be formed on the puzzle pieces and the holes in the reference member. Moreover, other securing means such as adhesives, hook and loop fasteners (Velcro) or magnets can be utilized, as long as the securing means allows the puzzle pieces to be releasably secured to the surface of the reference member. The securing means may be positioned in discrete locations to provide guidance as to how the puzzle pieces are to be located or may generally cover substantially all of the surface of the reference member.

It is further understood that any combination of letters and/or numerals can be used for the puzzle pieces and that a reference member formed of more than six sides is also possible. The arrangement of puzzle pieces on each side substantially covers the surface of that side but regions are provided where the surface of the reference member is exposed to permit access to the puzzle pieces for removal thereof.

The outer surfaces of the puzzle pieces may be color coded so that each side of the puzzle is a different color. The corresponding faces of the reference member may be colored in a like manner. In a preferred embodiment of a children's puzzle, the three primary colors are positioned on sides opposite to the three secondary colors so that the puzzle also serves to teach color. In an adult puzzle, the color coding or indicia on the reference member would be dispensed with and materials such as chrome or transparent plastics could be used.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A three-dimensional puzzle comprising a reference member formed with an exterior surface defining a plurality of rectangular planar sides; a plurality of puzzle pieces each shaped to correspond to a letter of the alphabet so that when positioned at predetermined locations on associated sides of said reference member said puzzle pieces substantially cover the surface of said reference member, all of the letters of the alphabet being represented by separate puzzle pieces, said reference member being provided with at least five rectangular sides, the puzzle pieces on each of said sides interfitting with each other to substantially define a rectangle corresponding to the associated side; and means for releasably securing said puzzle pieces at corresponding positions on said sides of said reference member including a first portion on said reference member defining discrete locations thereon for receipt of correspondng puzzle pieces and a second portion on said puzzle pieces for cooperative releasable engagement with corresponding engaging means of said first portion.

2. A puzzle as recited in claim 1, wherein said puzzle pieces on a sixth rectangular side define numerals interfitted with each other to substantially define a rectangle corresponding to the associated side.

3. A puzzle as recited in claim 1, wherein one of said first and second portions of said releasable securing means includes pegs projecting from one of said puzzle pieces and reference member and the other of said first and second portions of said releasable securing means includes holes positioned for mating engagement with said pegs formed in the other of said puzzle pieces and reference member.

4. A puzzle as recited in claim 1, wherein said reference member substantially defines a cube.

5. A puzzle as recited in claim 1, wherein said cube is formed with a compartment therein and means providing selective access to said compartment.

6. A puzzle as recited in claim 1, wherein a first side of the puzzle is substantially shown in FIG. 5, a second side of the puzzle is substantially shown in FIG. 6, a third side of the puzzle is substantially shown in FIG. 7, a fourth side of the puzzle is substantially shown in FIG. 8, a fifth side of the puzzle is substantially shown in FIG. 9, and a sixth side of the puzzle is substantially shown in FIG. 10.

7. A puzzle as recited in claim 1, wherein a first side of the puzzle is substantially shown in FIG. 11, a second side of the puzzle is substantially shown in FIG. 12, a third side of the puzzle is substantially shown in FIG. 13, a fourth side of the puzzle is substantially shown in FIG. 14, a fifth side of the puzzle is substantially shown in FIG. 15, and a sixth side of the puzzle is substantially shown in FIG. 16.

8. A puzzle as claimed in claim 2, wherein a first side of the puzzle is substantially shown in FIG. 17, a second side of the puzzle is substantially shown in FIG. 18, a third side of the puzzle is substantially shown in FIG. 19, a fourth side of the puzzle is substantially shown in FIG. 20, a fifth side of the puzzle is substantially shown in FIG. 21 and a sixth side of the puzzle is substantially shown in FIG. 22.

9. A puzzle as claimed in claim 2, wherein a first side of the puzzle is substantially shown in FIG. 23, a second side of said puzzle is substantially shown in FIG. 24, a third side of said puzzle is substantially shown in FIG. 25, a fourth side of said puzzle is substantially shown in FIG. 26, a fifth side of said puzzle is substantially shown in FIG. 18, and a sixth side of said puzzle is substantially shown in FIG. 21.

10. A puzzle as claimed in claim 2, wherein a first side of the puzzle is substantially shown in FIG. 27, a second side of the puzzle is substantially shown in FIG. 26, a third side of the puzzle is substantially shown in FIG. 25, a fourth side of the puzzle is substantially shown in FIG. 18, a fifth side of the puzzle is substantially shown in FIG. 22, and a sixth side of the puzzle is substantially shown in FIG. 21.

Figure 5:
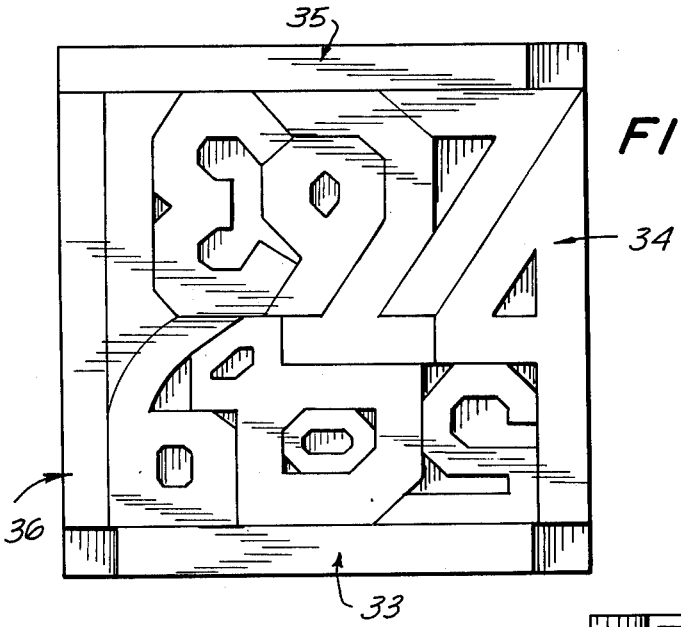
FIGS. 5, 6, 7, 8, 9 and 10 are plan views of the rear, top, front, bottom, right and left sides respectively, of an alphabet puzzle constructed in accordance with a first embodiment of the instant invention.

11. A puzzle as recited in claim 2, wherein one side of said puzzle is substantially as shown in FIG. 5.

Figure 6:
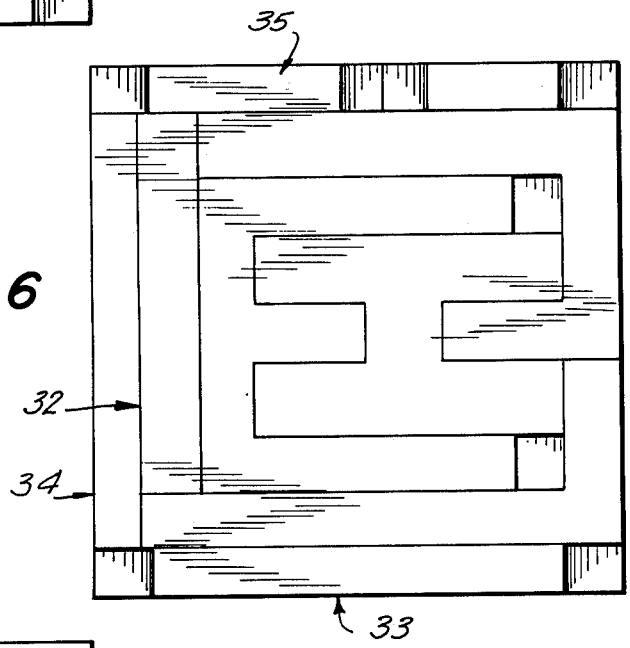

12. A puzzle as recited in claim 1, wherein one side of said puzzle is substantially as shown in FIG. 6.

Figure 7:
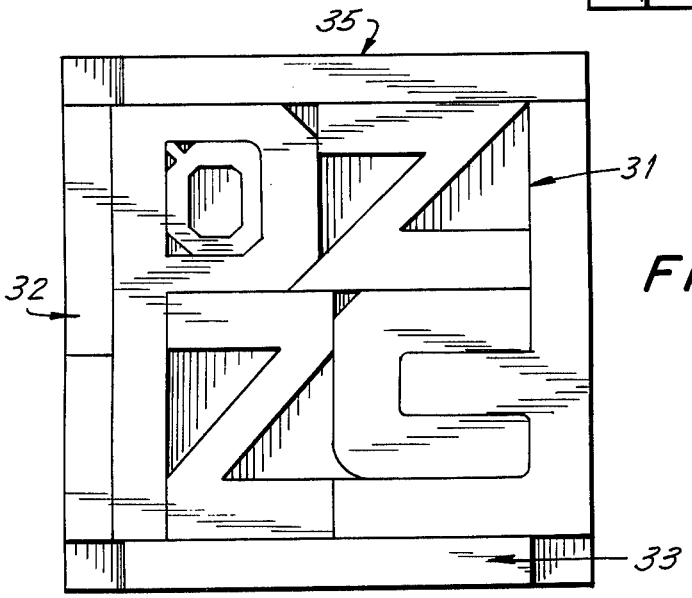

13. A puzzle as recited in claim 1, wherein one side of said puzzle is substantially as shown in FIG. 7.

14. A puzzle as recited in claim 1, wherein one side of said puzzle is substantially as shown in FIG. 8.

Figure 9:
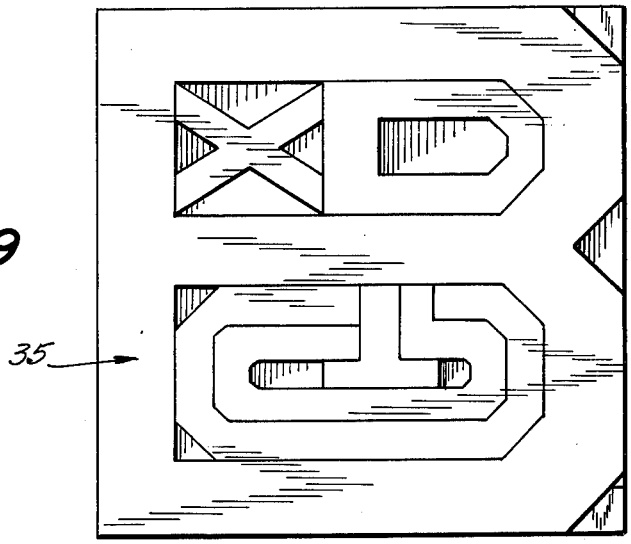

15. A puzzle as recited in claim 1, wherein one side of said puzzle is substantially as shown in FIG. 9.

Figure 10:
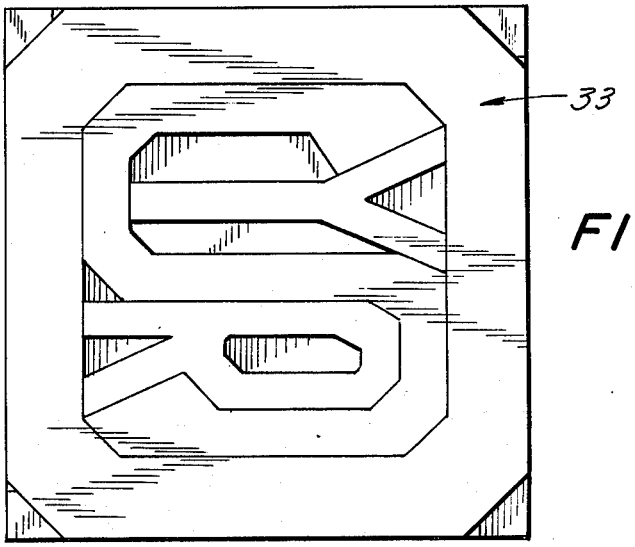

16. A puzzle as recited in claim 1, wherein one side of said puzzle is substantially as shown in FIG. 10.

Figure 11:
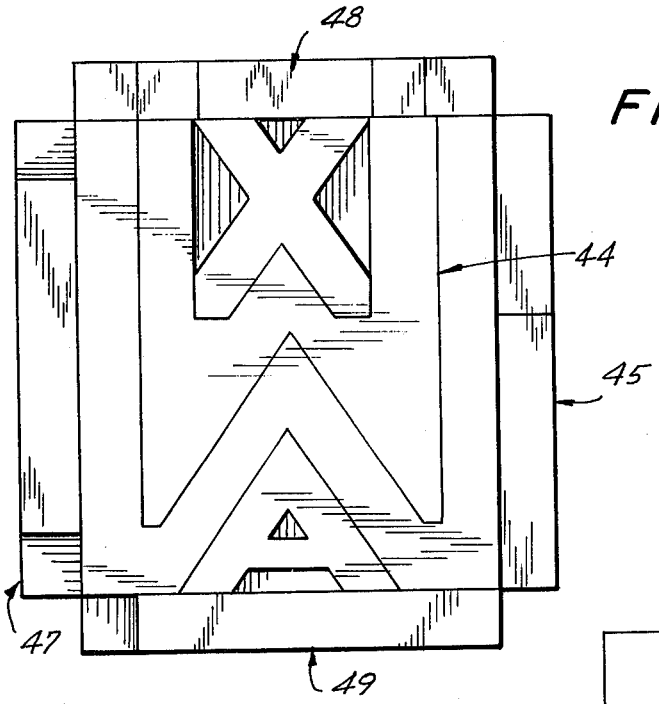
FIGS. 11, 12, 13, 14, 15 and 16 are plan views of the front, right, rear, left, top and bottom sides respectively, of an alphabet puzzle constructed in accordance with a second embodiment of the instant invention.

17. A puzzle as recited in claim 1, wherein one side of said puzzle is substantially as shown in FIG. 11.

Figure 12:
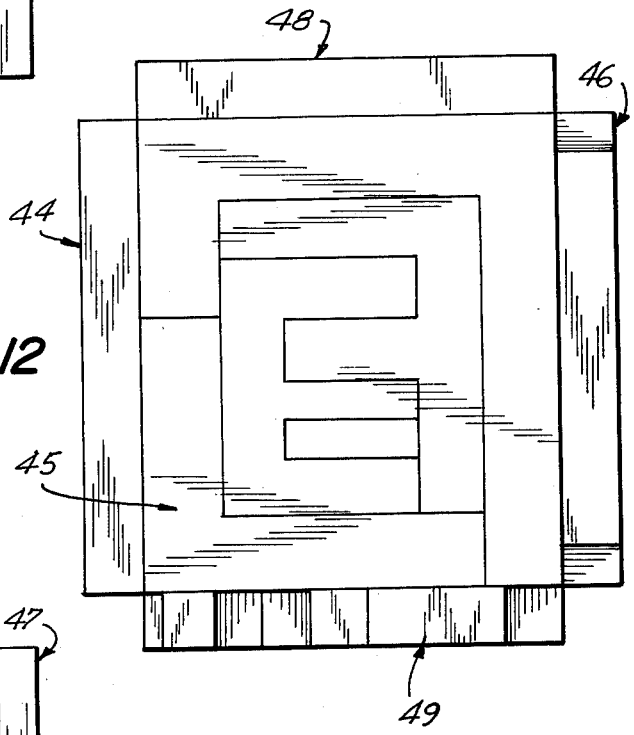

18. A puzzle as recited in claim 1, wherein one side of said puzzle is substantially as shown in FIG. 12.

Figure 13:
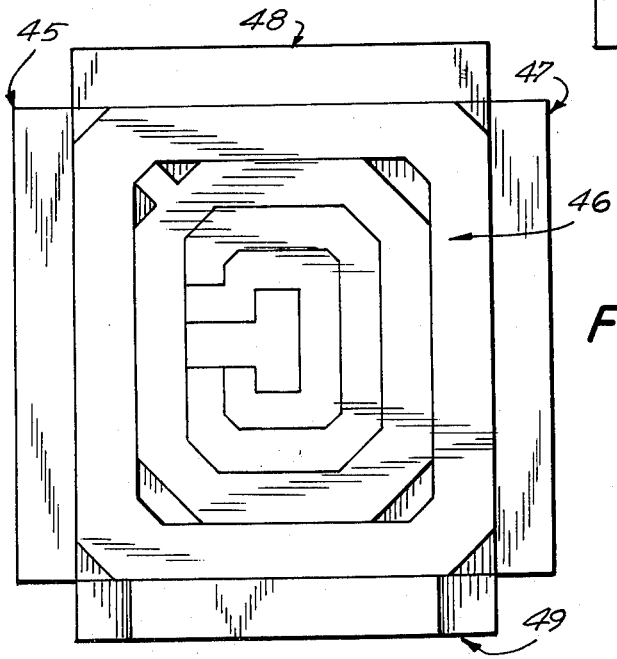

19. A puzzle as recited in claim 1, wherein one side of said puzzle is substantially as shown in FIG. 13.

Figure 14:
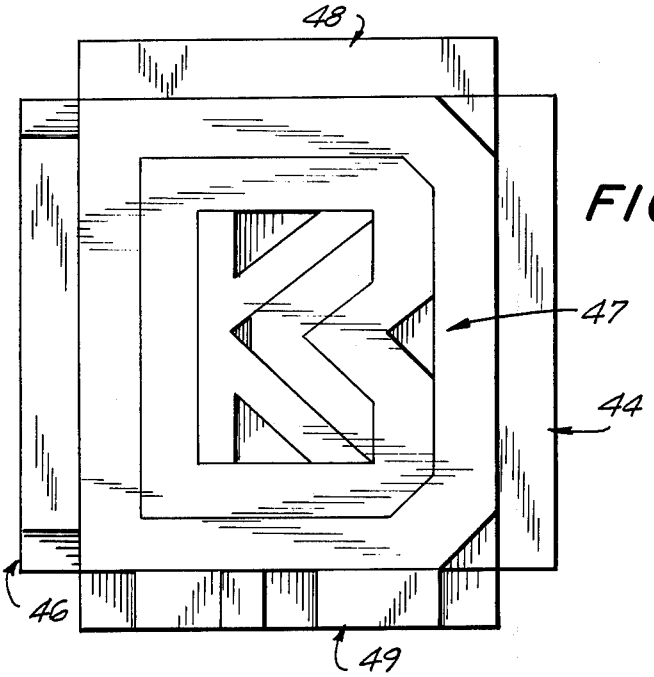

20. A puzzle as recited in claim 1, wherein one side of said puzzle is substantially as shown in FIG. 14.

Figure 15:
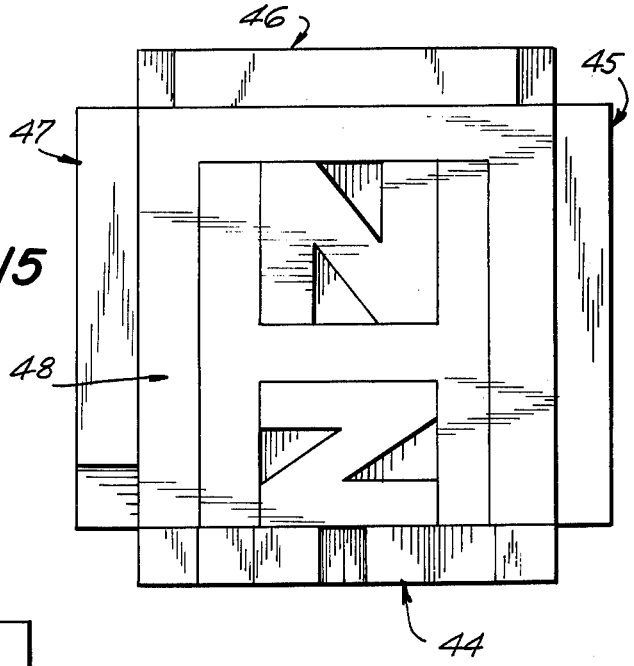

21. A puzzle as recited in claim 1, wherein one side of said puzzle is substantially as shown in FIG. 15.

Figure 16:
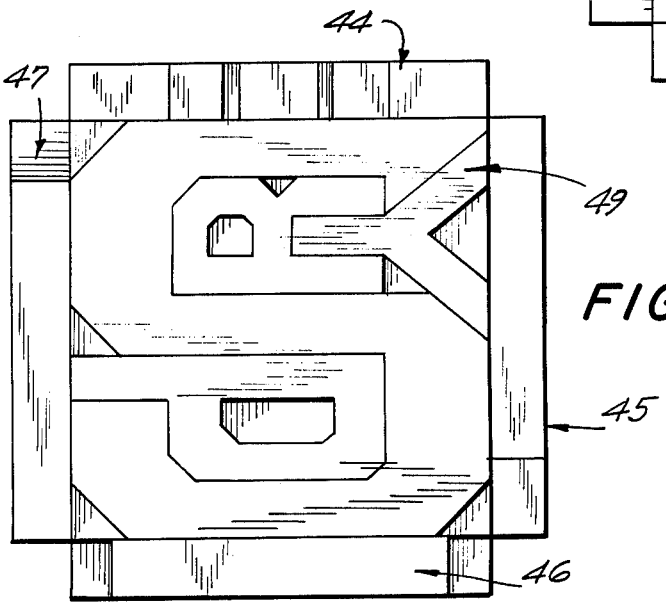

22. A puzzle as recited in claim 1, wherein one side of said puzzle is substantially as shown in FIG. 16.

Figure 17:
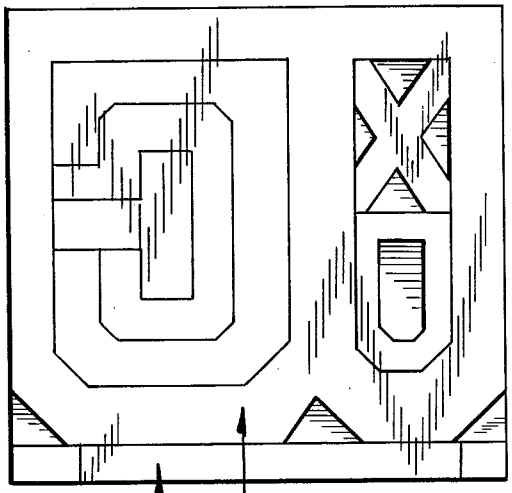
FIGS. 17, 18, 19, 20, 21 and 22 are plan views of front, right, rear, left, top and bottom sides of an alphabet puzzle constructed in accordance with a third embodiment of the instant invention.

23. A puzzle as recited in claim 1, wherein one side of said puzzle is substantially as shown in FIG. 17.

24. A puzzle as recited in claim 1, wherein one side of said puzzle is substantially as shown in FIG. 18.

Figure 19:
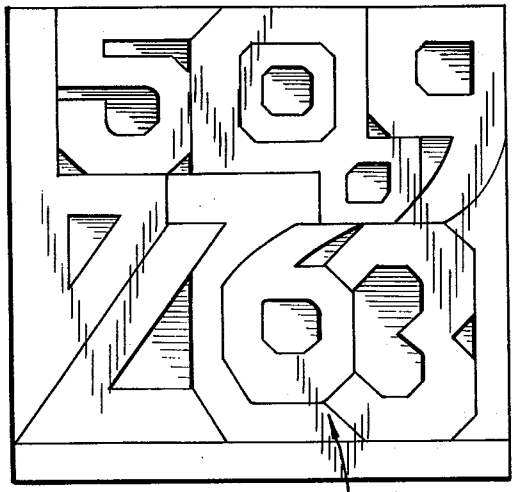

25. A puzzle as recited in claim 1, wherein one side of said puzzle is substantially as shown in FIG. 19.

Figure 20:
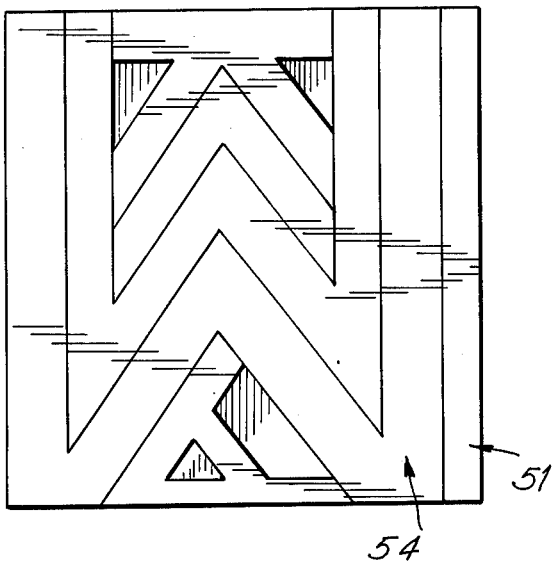

26. A puzzle as recited in claim 1, wherein one side of said puzzle is substantially as shown in FIG. 20.

27. A puzzle as recited in claim 1, wherein one side of said puzzle is substantially as shown in FIG. 21.

28. A puzzle as recited in claim 1, wherein one side of said puzzle is substantially as shown in FIG. 22.

Figure 23:
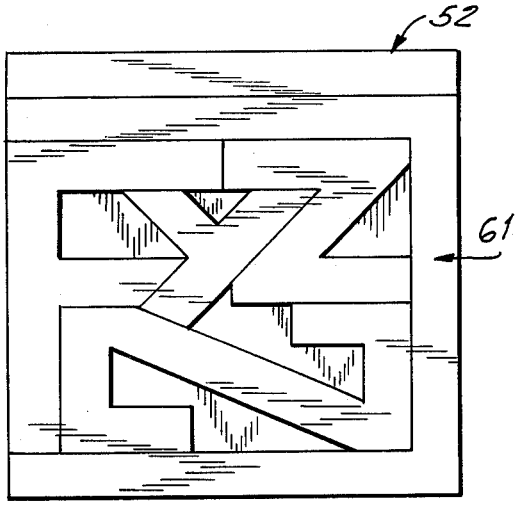
FIGS. 23, 24, 25 and 26 are front, bottom, rear and left plan views of an alphabet puzzle in accordance with a fourth embodiment of the invention.

29. A puzzle as recited in claim 1, wherein one side of said puzzle is substantially as shown in FIG. 23.

Figure 24:
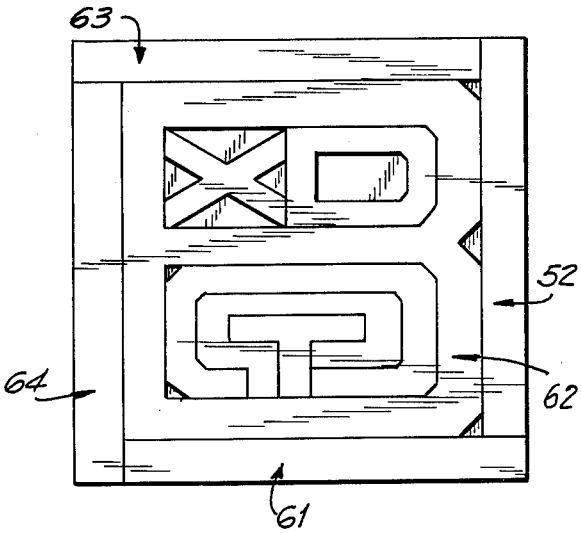

30. A puzzle as recited in claim 1, wherein one side of said puzzle is substantially as shown in FIG. 24.

31. A puzzle as recited in claim 1, wherein one side of said puzzle is substantially as shown in FIG. 25.

32. A puzzle as recited in claim 1, wherein one side of said puzzle is substantially as shown in FIG. 26.

33. A puzzle as recited in claim 1, wherein one side of said puzzle is substantially as shown in FIG. 27.

34. A puzzle as recited in claim 1, wherein the puzzle pieces on one side of said reference member define an opening providing access to the surface of said reference member, and including stand means and means on said stand means and the exposed portion of the surface of said reference member for releasably mounting said reference member on said stand.

35. An alphabet puzzle comprising a reference member having an exterior surface formed with at least five rectangular sides, a plurality of puzzle pieces each shaped to correspond to a letter of the alphabet, all of the letters of the alphabet being represented by separate puzzle pieces, the puzzle pieces on each of said sides interfitting with each other to substantially define a rectangle corresponding to and substantially covering the associated side; and means on said reference member and puzzle pieces for releasably securing said puzzle pieces on said reference member surface.

36. A puzzle as recited in claim 35, wherein said puzzle pieces on a sixth rectangular side define numerals interfitted with each other to substantially define a rectangle corresponding to the associated section.

37. The puzzle as rectied in claim 35, wherein said releasable securing means includes pegs positioned on one of said reference member and puzzle pieces and holes formed in the other of said reference member and puzzle pieces and positioned for receiving said pegs when said puzzle pieces are properly aligned.

38. A puzzle as recited in claim 36, wherein a first side of the puzzle is substantially shown in FIG. 5, a second side of the puzzle is substantially shown in FIG. 6, a third side of the puzzle is substantially shown in FIG. 7, a fourth side of the puzzle is substantially shown in FIG. 8, a fifth side of the puzzle is substantially shown in FIG. 9, and a sixth side of the puzzle is substantially shown in FIG. 10.

39. A puzzle as recited in claim 35, wherein a first side of the puzzle is substantially shown in FIG. 11, a second side of the puzzle is substantially shown in FIG. 12, a third side of the puzzle is substantially shown in FIG. 13, a fourth side of the puzzle is substantially shown in FIG. 14, a fifth side of the puzzle is substantially shown in FIG. 15, and a sixth side of the puzzle is substantially shown in FIG. 16.

40. A puzzle as claimed in claim 36, wherein a first side of the puzzle is substantially shown in FIG. 17, a second side of the puzzle is substantially shown in FIG. 18, a third side of the puzzle is substantially shown in FIG. 19, a fourth side of the puzzle is substantially shown in FIG. 20, a fifth side of the puzzle is substantially shown in FIG. 21 and a sixth side of the puzzle is substantially shown in FIG. 22.

41. A puzzle as claimed in claim 36, wherein a first side of the puzzle is substantially shown in FIG. 23, a second side of said puzzle is substantially shown in FIG. 24, a third side of said puzzle is substantially shown in FIG. 25, a fourth side of said puzzle is substantially shown in FIG. 26, a fifth side of said puzzle is substantially shown in FIG. 18, and a sixth side of said puzzle is substantially shown in FIG. 21.

42. A puzzle as claimed in claim 36, wherein a first side of the puzzle is substantially shown in FIG. 27, a second side of the puzzle is substantially shown in FIG. 26, a third side of the puzzle is substantially shown in FIG. 25, a fourth side of the puzzle is substantially shown in FIG. 18, a fifth side of the puzzle is substantially shown in FIG. 22, and a sixth side of the puzzle is substantially shown in FIG. 21.

43. A puzzle as recited in claim 36, wherein one section of said puzzle is substantially as shown in FIG. 5.

44. A puzzle as recited in claim 35, wherein one side of said puzzle is substantially as shown in FIG. 6.

45. A puzzle as recited in claim 35, wherein one side of said puzzle is substantially as shown in FIG. 7.

46. A puzzle as recited in claim 35, wherein one side of said puzzle is substantially as shown in FIG. 8.

47. A puzzle as recited in claim 35, wherein one side of said puzzle is substantially as shown in FIG. 9.

48. A puzzle as recited in claim 35, wherein one side of said puzzle is substantially as shown in FIG. 10.

49. A puzzle as recited in claim 35, wherein one side of said puzzle is substantially as shown in FIG. 11.

50. A puzzle as recited in claim 35, wherein one side of said puzzle is substantially as shown in FIG. 12.

51. A puzzle as recited in claim 35, wherein one side of said puzzle is substantially as shown in FIG. 13.

52. A puzzle as recited in claim 35, wherein one side of said puzzle is substantially as shown in FIG. 14.

53. A puzzle as recited in claim 35, wherein one side of said puzzle is substantially as shown in FIG. 15.

54. A puzzle as recited in claim 35, wherein one side of said puzzle is substantially as shown in FIG. 16.

55. A puzzle as recited in claim 35, wherein one side of said puzzle is substantially as shown in FIG. 17.

56. A puzzle as recited in claim 35, wherein one side of said puzzle is substantially as shown in FIG. 18.

57. A puzzle as recited in claim 36, wherein one side of said puzzle is substantially as shown in FIG. 19.

58. A puzzle as recited in claim 35, wherein one side of said puzzle is substantially as shown in FIG. 20.

59. A puzzle as recited in claim 35, wherein one side of said puzzle is substantially as shown in FIG. 21.

60. A puzzle as recited in claim 35, wherein one side of said puzzle is substantially as shown in FIG. 22.

61. A puzzle as recited in claim 35, wherein one side of said puzzle is substantially as shown in FIG. 23.

62. A puzzle as recited in claim 35, wherein one side of said puzzle is substantially as shown in FIG. 24.

63. A puzzle as recited in claim 35, wherein one side of said puzzle is substantially as shown in FIG. 25.

64. A puzzle as recited in claim 36, wherein one side of said puzzle is substantially as shown in FIG. 26.

65. A puzzle as recited in claim 35, wherein one side of said puzzle is substantially as shown in FIG. 27.

66. A puzzle as recited in claim 35, wherein the bottom edge of each of said alphabetic puzzle pieces when viewed as a letter is formed with a substantially flat surface to support each said piece in an upright position apart from said reference member.

67. An alphabet puzzle comprising a reference member having a surface, a plurality of puzzle pieces shaped for mounting on said surface and means for releasably securing said puzzle pieces on said surface, said puzzle pieces being shaped substantially as shown in FIGS. 6, 7, 8, 9 and 10.

68. An alphabet puzzle comprising a reference member having a surface, a plurality of puzzle pieces shaped for mounting on said surface and means for releasably securing said puzzle pieces on said surface, said puzzle pieces being shaped substantially as shown in FIGS. 11, 12, 13, 14, 15 and 16.

69. An alphabet puzzle comprising a reference member having a surface, a plurality of puzzle pieces shaped for mounting on said surface and means for releasably securing said puzzle pieces on said surface, said puzzle pieces being shaped substantially as shown in FIGS. 17, 18, 20, 21 and 22.

70. An alphabet puzzle comprising a reference member having a surface, a plurality of puzzle pieces shaped for mounting on said surface and means for releasably securing said puzzle pieces on said surface, said puzzle pieces being shaped substantially as shown in FIGS. 23, 24, 25, 18 and 21.

71. An alphabet puzzle comprising a reference member having a surface, a plurality of puzzle pieces shaped for mounting on said surface and means for releasably securing said puzzle pieces on said surface, said puzzle pieces being shaped substantially as shown in FIGS. 27, 26, 25, 18, 22 and 21.

* * * * *